US005408932A

United States Patent [19]

Hesse et al.

[11] Patent Number: 5,408,932

[45] Date of Patent: Apr. 25, 1995

[54] LONG ROD EXTENSION SYSTEM UTILIZING SHAPE MEMORY ALLOY

[75] Inventors: Philip W. Hesse, Ellicott City; David Goldstein, Potomac, both of Md.

[73] Assignee: The United States of America as represented by the Secretary of the Navy, Washington, D.C.

[21] Appl. No.: 301,505

[22] Filed: Sep. 7, 1994

[51] Int. Cl.[6] ..... F42B 12/02

[52] U.S. Cl. ..... 102/501; 102/474; 102/520

[58] Field of Search ..... 102/501, 520, 521, 522, 102/523, 517, 474; 148/402

[56] References Cited

U.S. PATENT DOCUMENTS 4,542,696 9/1985 Bisping et al. ..... 102/523
4,704,968 11/1987 Davis ..... 102/517
5,046,948 9/1991 Miura ..... 433/21
5,107,916 4/1992 van Roermund et al. ..... 160/6
5,196,650 3/1993 Cytron ..... 102/521
5,271,975 12/1993 Solano ..... 428/34.9
5,317,612 5/1994 Bryan et al. ..... 376/451

*Primary Examiner*—Charles T. Jordan
*Attorney, Agent, or Firm*—Jacob Shuster

[57] ABSTRACT

An elongated rod made of a shape memory alloy composition having selected pseudoelastic properties, is deformed into a dimensionally compact coil for packaged storage under stress maintained by physical constraint. Upon selective removal of the constraint allowing shape recovery, a substantial increase in axial length of the rod occurs in order to improve its performance in various installations, including long rod penetrating projectiles.

15 Claims, 4 Drawing Sheets

LONG ROD EXTENSION SYSTEM UTILIZING SHAPE MEMORY ALLOY

This invention relates generally to the packaging of long rod components prior to use thereof in a dimensionally extended condition.

BACKGROUND OF THE INVENTION

The reshaping of deformable components for use-on-demand, is generally well known in various arts, including ballistic missile or projectile installations as disclosed for example in U.S. Pat. Nos. 4,704,968, 4,964,341 and 4,979,443 to Davis, Jr., Hebert and Rittel et al., respectively. The Davis, Jr. patent furthermore discloses the concept of deforming and reshaping a component made of a shape memory alloy in a projectile installation. As to the prior art availability of shape memory alloys having different properties dependent on alloy composition factors, including pseudoelasticity properties at room temperatures and lows, U.S. Pat. No. 4,894,100 to Yamauchi et al. is relevant. Such pseudoelasticity property of a shape memory alloy is based on its martensitic transition induced by stress applied thereto, and subsequent phase transformation to the austenitic state without heating by release of the stress according to the Yamauchi et al. patent, which does not however relate to or suggest use of shape memory alloy properties for prepackaging of components made from such alloys so as to improve performance involving the reshaping of the packaged components. While the Davis, Jr. patent does teach the use of a shape memory alloy to improve target penetration, such teaching is limited to reshaping the projectile in accordance with thermoelastic properties dependent on temperature conditions resulting from heat generated by target impact.

It is therefore an important object of the present invention to provide an arrangement and method for reshaping shape memory alloy components to and from a compact packaged condition, dependent exclusively on the pseudoelastic and/or superelastic property of the alloy under a wide range of operating temperatures.

It is a further object of the invention in accordance with the foregoing object to functionally improve performance of shape memory alloy components in projectiles, such as the penetration of targets by long rod penetrators, without reliance on the effects of target impact including heating to provide a rise in temperature according to the Davis, Jr. patent aforementioned herein.

SUMMARY OF THE INVENTION

In accordance with the present invention, the composition of shape memory alloy material, such as Nitinol, is selected to display the desired pseudoelastic and/or superelastic properties under a wide range of operating temperatures in a martensite/austenite condition of an elongated rod deformed into a coil or serpentine shape for storage or packaging purposes prior to use of the rod while undergoing shape recovery. The packaged rod retains its coiled or serpentine shape under deformation stress by physical constraint, which is selectively removed to induce pseudoelastic and/or superelastic change reflected by shape recovery extension into elongated rod shape.

The elongated rod may be utilized as a target penetrator associated with a projectile within which the rod is packaged and stored in coiled condition prior to launch under physical constraint retaining the deformation stress therein. Such constraint is removed before impact during flight of the projectile from its launch site toward the target.

BRIEF DESCRIPTION OF DRAWING FIGURES

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENTS

Figure 1A:
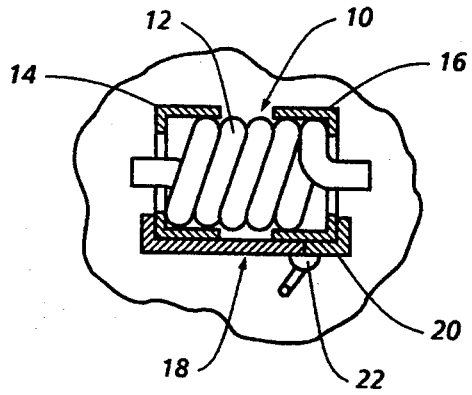
FIG. 1A is a side section view through a shape memory component under constraint in a packaged storage condition, in accordance with one embodiment of the invention.

Referring now to the drawing in detail, FIG. 1A illustrates a shape memory alloy component in a packaged condition according to one embodiment of the invention, in the form of a closely wound helical coil generally referred to by reference numeral 10. The coil 10 is formed from a rod 12 made of shape memory alloy, such as Nitinol, having a nickel/titanium atomic composition ratio of 50.5% to 49.5% (1.002). The rod 12 in such embodiment has a 0.1 inch diameter and a linear length of 35 inches and is helically wound at room temperature on a mandrel of 11/8 inch diameter, to thereby substantially deform it into coil 10 having an axial length of 1 inch.

The shape memory alloy composition of the rod 12 was chosen to assure that it is in a totally austenitic state before it is deformed into its helical coil shape at or below room temperature. The deformation of the rod 12 into the shape of coil 10 was then induced under stress to effect its phase transformation to the martensitic state by an accompanying increase in temperature in accordance with the prior art as aforementioned herein. The stress is however applied to rod 12 in accordance with the present invention within permissible strain limits of 8% to 10%, in order to avoid permanent deformation while producing the phase transformation of the shape memory alloy to its martensitic state.

Figure 1B:
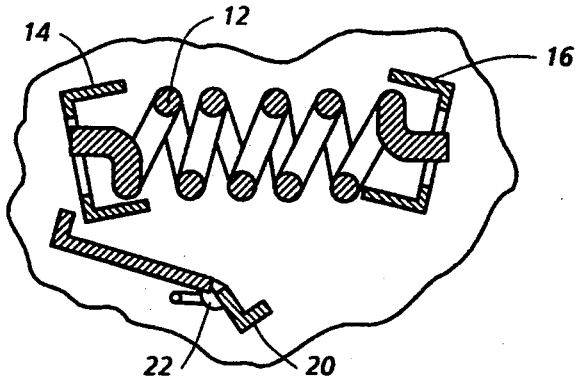
FIGS. 1B and 1C are side section views of the shape memory component of FIG. 1A in different phases of elongation following constraint release.
Figure 1C:
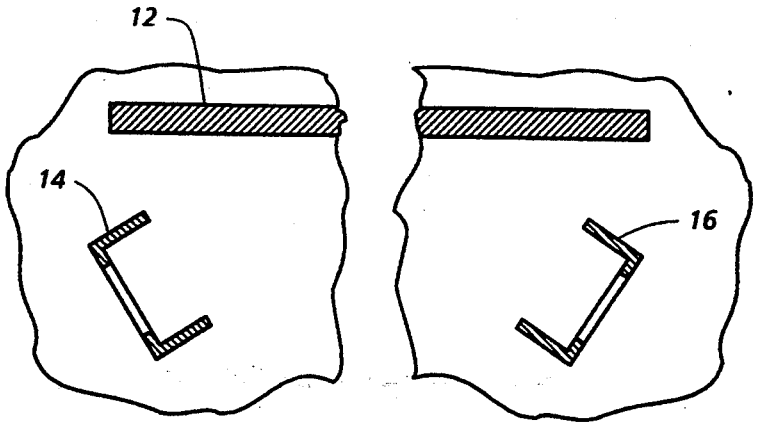

FIG. 1A shows the coil 10 axially retained between end caps 14 and 16 of a stress retention device generally referred to by reference numeral 18. In such illustrated embodiment, the device 18 also has a pivoted section 20 releasably retained in engagement with end cap 16 by means of a selectively releasable latch mechanism 22. Accordingly, upon release of the latch 22 as shown in FIG. 1B, deformation stress in the coiled rod 12 is relieved as axial expansion of the coil 10 occurs until complete shape recovery of the rod 12 is attained as shown in FIG. 1C. Such shape recovery of the rod 12 is achieved pseudoelastically in a very short period of time, such as 44 milliseconds, upon removal of the physical constraint of the caps 14 and 16 which had maintained the coil 10 under stress. In the full recovery condition of rod 12, as shown in FIG. 1C, its shape memory alloy material is restored to the austenitic state at room temperature.

Figure 2A:
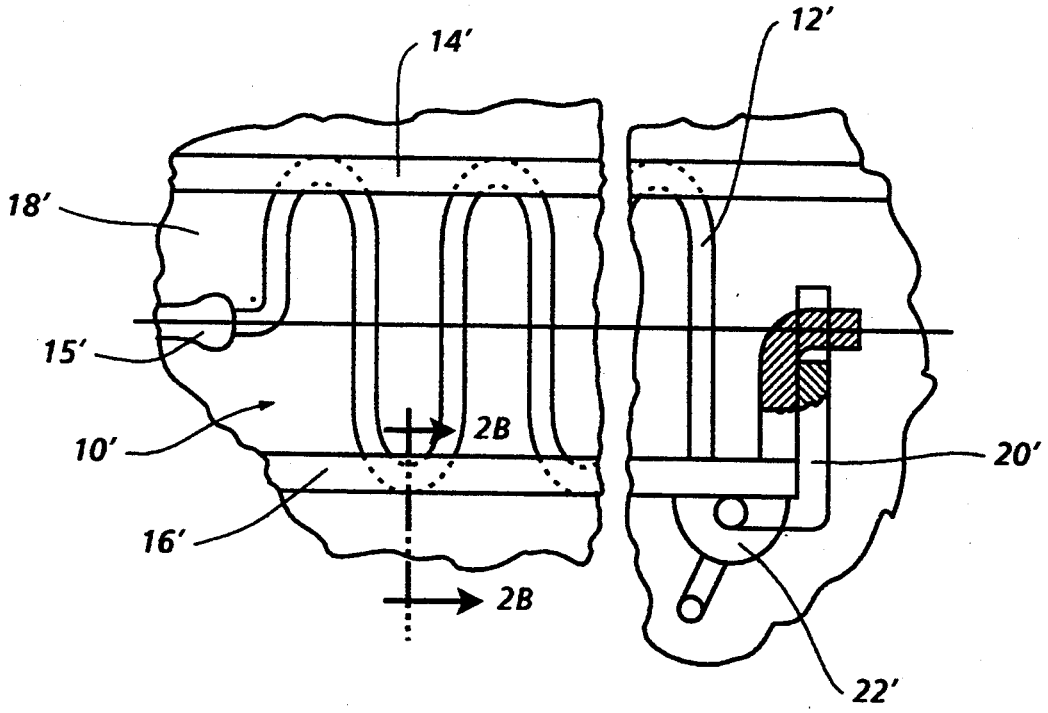
FIG. 2A is a partial side view of a shape memory component under constraint in a packaged condition, in accordance with another embodiment of the invention.
Figure 2B:
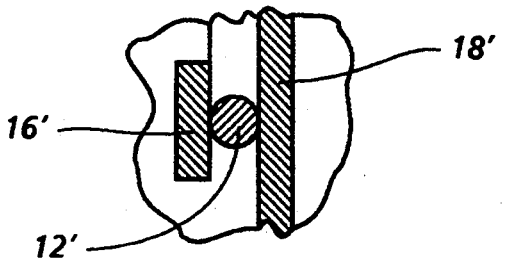
FIG. 2B is a partial section view taken substantially through a plane indicated by section line 2B—2B in FIG. 2A.

In accordance with another embodiment of the invention, a shape memory rod 12' is packaged and retained under stress in a serpentine configuration 10' as depicted in FIG. 2A. Toward that end, one end of the rod 12' is anchored by a clamp 15 to a base 18' while in its deformed serpentine shape between parallel spaced bars 14' and 16' fixed to the base. The rod is in frictional sliding contact with the bars 14' and 16' as shown in FIG. 2B with its end opposite clamp 15 in engagement with a pivoted retention element 20' pivotedly connected to a selectively releasable latch 22'. Accordingly, upon release of latch 22', deformation stress in the rod 12' is relieved as the constraint of pivoted element 20' is removed, to allow pseudoelastic shape recovery of rod 12' as hereinbefore described with respect to coil 10 in FIGS. 1A, 1B and 1C.

Figure 3:
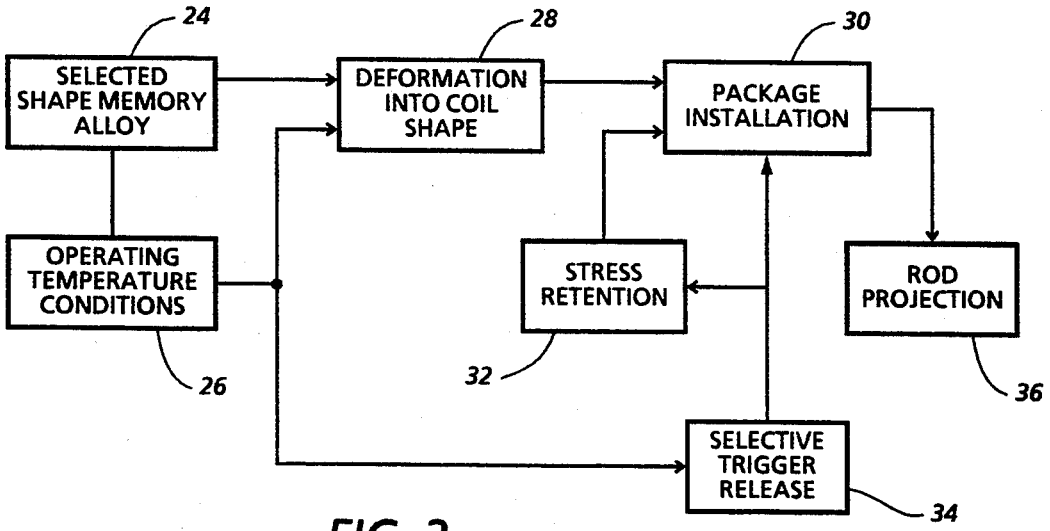
FIG. 3 is a block diagram depicting the method associated with the present invention.

A shape memory component may be packaged pursuant to the present invention for installation and use in different applications. The procedure involved is summarized in the block diagram of FIG. 3, wherein block 24 denotes the selection of the shape memory alloy composition for a rod, in terms of the Ni/Ti ratio necessary to accommodate pseudoelastic and/or superelastic change in state within a desired operating temperature range such as 5° C. to 65° C. as denoted by block 26. After dimensional deformation of the rod into a packaged condition within the operating temperature range, as denoted by block 28, the packaged rod is placed in some installation as denoted by block 30. The rod is maintained in its installational package shape by stress retention, as denoted by block 32, until the stress is relieved by selective trigger release of the package constraint, as denoted by block 34, under operating temperature conditions. Upon removal of the retention stress, the packaged rod undergoes pseudoelastic change and transformation from the martensitic state to the austenitic state of its shape memory alloy material, involving shape recovering projection, as denoted by block 36 in FIG. 3.

Figure 6:
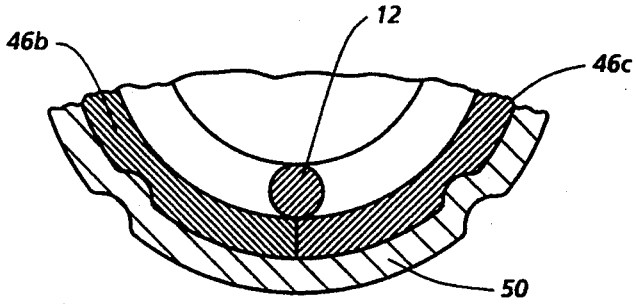
FIG. 6 is a partial section view taken substantially through a plane indicated by section line 6—6 in FIG. 4.
Figure 4:
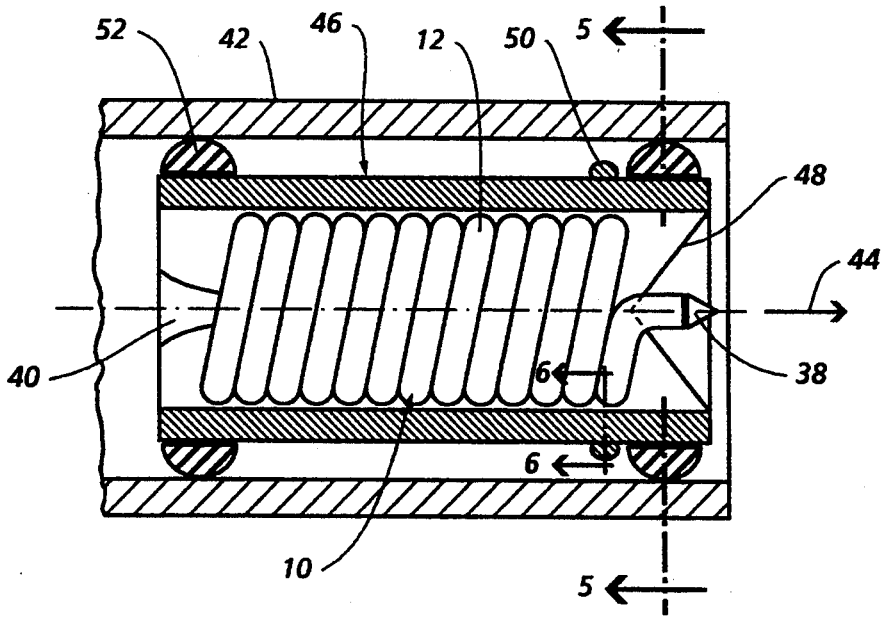
FIG. 4 is a side section view through a portion of a long rod penetrator type of projectile within which the present invention is installed.
Figure 5:
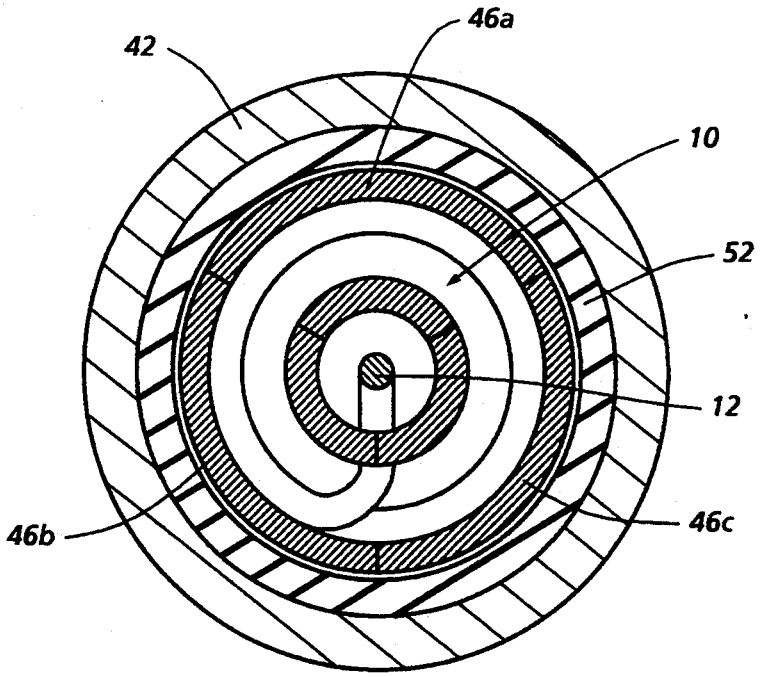
FIG. 5 is a transverse section view taken substantially through a plane indicated by section line 5—5 in FIG. 4.

FIG. 4 illustrates a projectile installation for the present invention, wherein the helical coil 10 as hereinbefore described is utilized as the dimensionally deformed rod 12 serving as a long rod penetrator having a target penetrating nose 38 at one end and a stabilizing fin 40 at the other end. The rod 12 is positioned, in its deformed package condition as coil 10 under stress, within a shell casing 42 ejected after firing of a gun from its breech causing launch of the coil 10 in the flight direction indicated by arrow 44 in FIG. 4. The coil 10 is retained in such installation under stress within a cylindrical sabot 46 from which the nose 38 of the rod projects. The sabot is formed by three arcuate sections **46*a*, 46*b* and 46*c*, as more clearly seen in FIG. 5, and has a nose end 48 of inwardly projecting conical shape as shown in FIG. 4. The sabot sections are maintained assembled in stress retaining relation to the coil 10 by a notched ring 50, as more clearly seen in FIG. 6, to releasably hold the coil 10 positioned in its packaged condition within the shell casing 42. Rotating bands 52, made of a material such as Nylon, are carried on the sabot 46 at opposite axial ends in sliding contact with the shell casing 42**, thereby acting as a gas seal for the projectile during launch from the gun barrel.

Figure 7:
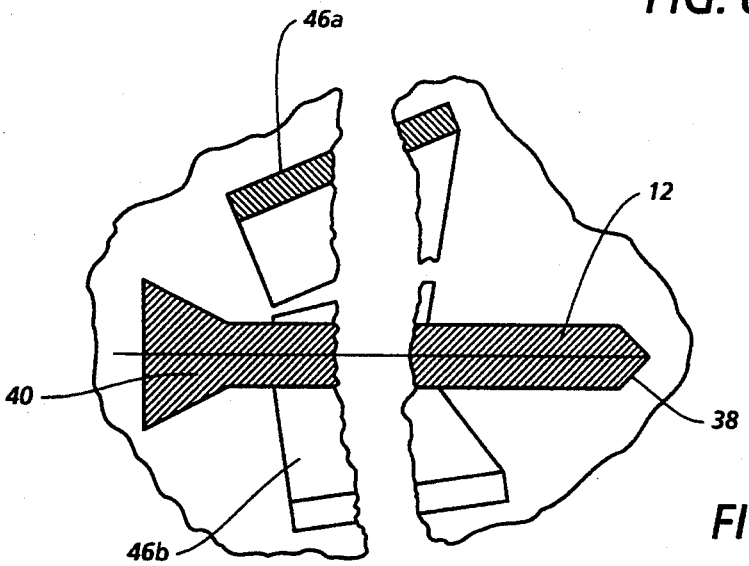
FIG. 7 is a partial side section view corresponding to that of FIG. 5, showing projection of the long rod penetrator from the projectile prior to target impact.

After exit of the sabot 46 and coil 10 from the gun barrel under a high velocity during launch, the ram air pressure entering the conical end 48 of the sabot sufficiently augments the radial expansion pressure being exerted by the stress in the coil 10 on the sabot sections to cause the gas seal bands 52 and stress retention ring element 50 to rupture. The sabot sections are accordingly disassembled as coil 10 undergoes pseudoelastic shape recovery resulting in axial elongation of the rod 12 prior to target impact, as shown in FIG. 7. It should of course be appreciated that other prior art stress retention constraints and associated constraint release devices could be utilized in the foregoing coil installation described, including triggered explosive devices.

It should also be appreciated that the foregoing described projectile installation for the coil 10 will significantly improve target penetration by rod 12 of substantial length as compared to prior art long rod penetrators which were heretofore limited in length by handling and storage considerations to 12 to 18 inches for example. Such a penetrator rod has a corresponding target penetration depth (D) at hyper-velocity in accordance with the formula:

$$D = L\sqrt{\frac{P_p}{P_t}},$$

where L is the penetrator rod length, Pp is the density of the rod and Pt is the density of the target. Thus, an 8 foot long penetrator rod 12 that is 16 times as long as prior art penetrators when deformed into a coil 10 having a 1.5 foot packaged axial length, as shown in FIG. 4 for example, provides a four fold increase in penetration depth (D) as compared to prior art penetrators because of the pseudoelastic extension of the coil 10 into the long rod 12 as shown in FIG. 7.

As hereinbefore indicated, the present invention is not limited to projectile installations. Other applications include, but are not limited to, rapid deploying and self-erecting antenna installations for various communication purposes on battlefields, life rafts, in ski emergency kits, etc., as well as use in locations such as outer space, deserts, mountain and arctic regions. Also, the present invention is useful as an extension handle for tools, self-erecting flares, self-erecting legs for cots and prepackaged fishing rods, where linear rod type extensions are critical.

Obviously, numerous other modifications and variations of the present invention are possible in light of the foregoing teachings. It is therefore to be understood that within the scope of the appended claims the invention may be practiced otherwise than as specifically described.

What is claimed is:

1. In a projectile having a rod adapted to impact a target; means for improving penetration of the target in response to said impact, including: formation of said rod from a shape memory alloy having a martensitic state and an austenitic state; and means operatively positioning the rod in a packaged condition within the projectile for pseudoelastic change in the state thereof prior to said impact.

2. The projectile as defined in claim 1 wherein said means for improving penetration further includes; restraining means for holding the rod deformed under stress in said packaged condition; and release means for relieving said stress from the rod in the packaged condition to enable said pseudoelastic change in the state thereof, causing shape recovering elongation of the rod.

3. The projectile as defined in claim 2 wherein said packaged condition of the rod is in the form of a helical coil which is axially extended by said shape recovering elongation as a long rod penetrator.

4. The projectile as defined in claim 2 wherein said restraining means comprises a sabot having arcuate sections releasably held by the release means assembled in enclosing relation to the rod in said packaged condition thereof.

5. The projectile as defined in claim 4 wherein said release means comprises a stress retention element in engagement with the arcuate sections of the sabot, said means operatively positioning the rod within the projectile comprising a shell casing and gas sealing means between the shell casing and the sabot for rupture together with the stress retention element in response to pressure generated as a result of projectile launch.

6. A ballistic projectile having an extensible nose and means connected to the nose for enhancing penetration of a target, including: a long rod connected to the nose and made of a shape memory alloy; said rod being releasably held retracted within the projectile in a packaged condition under stress; and means releasing the rod from said stress prior to impact of the target for causing pseudoelastic change in state of the shape memory alloy during projection of the rod from the projectile in a launch direction.

7. In combination with a device from which an elongated component made of a shape memory alloy is projected; means positioning the component deformed into a packaged condition under stress within said device, including retention means releasably holding the component in said packaged condition for pseudoelectric shape memory recovery of the shape memory alloy in response to release from the stress causing projection of the component from the device.

8. The combination as defined in claim 7 wherein said device is a projectile having a forward end from which the component is projected as a long rod penetrator.

9. The combination as defined in claim 7 wherein said retention means comprises: axially spaced end caps, and selectively releasable latch means for holding the end caps in engagement with the component in said packaged condition thereof.

10. The combination as defined in claim 7 wherein said component is extended during said projection thereof by said pseudoelectric shape memory recovery from a martensitic state into an axially elongated rod in an austenitic state of the shape memory alloy.

11. The combination as defined in claim 10 wherein said device is a projectile having a forward end from which the elongated rod is projected.

12. The combination as defined in claim 10 wherein said retention means comprises: axially spaced end caps, and selectively releasable latch means for holding the end caps in engagement with the component in said packaged condition thereof.

13. A method of utilizing a component made of a shape memory alloy under predetermined operating temperature conditions, including the steps of: selecting the shape memory alloy of the component to accommodate phase transformation thereof under said predetermined operating temperature conditions; packaging the component under stress; retaining said component packaged under said stress in a martensitic state of the selected shape memory alloy; and selectively removing said stress from the packaged component to enable subsequent use thereof by shape recovery extension into an elongated rod in an austenitic state of the shape memory alloy.

14. The method of claim 13 wherein said step of packaging the component comprises: effecting the phase transformation to the martensitic state of the shape memory alloy; and deforming the elongated rod into a helically coiled condition of the component while said phase transformation thereof to the martensitic state is being effected.

15. The method of claim 13 wherein said step of selecting the shape memory alloy includes selection of a ratio of nickel/titanium corresponding to said predetermined operating temperature conditions.

* * * * *